United States Patent [19]

Escher et al.

[11] Patent Number: 4,512,873

[45] Date of Patent: Apr. 23, 1985

[54] PROCESS FOR LOW TEMPERATURE CARBONIZATION OF HYDROGENATION RESIDUES

[75] Inventors: Gert Escher, Gelsenkirchen; Rolf Holighaus, Julich; Hans-Peter Wenning, Dorsten-Rhade, all of Fed. Rep. of Germany

[73] Assignee: Veba Oel Entwicklungs-Gesellschaft mbH, Gelsenkirchen, Fed. Rep. of Germany

[21] Appl. No.: 568,792

[22] Filed: Jan. 6, 1984

[30] Foreign Application Priority Data

Jan. 7, 1983 [DE] Fed. Rep. of Germany ..... 3300365

[51] Int. Cl.[3] ..... C10G 1/06; C10G 1/00; C10G 17/00

[52] U.S. Cl. ..... 208/13; 208/10; 208/8 R; 208/106

[58] Field of Search ..... 208/10, 13, 8 R, 106

[56] References Cited

U.S. PATENT DOCUMENTS

| | | | |
|---|---|---|---|
| 1,789,312 | 1/1931 | Knowles . | |
| 2,676,908 | 4/1954 | Noel | 208/10 |
| 3,018,241 | 11/1962 | Gorin | 208/10 |

FOREIGN PATENT DOCUMENTS

| | | |
|---|---|---|
| 557744 | 8/1932 | Fed. Rep. of Germany . |
| 582717 | 8/1933 | Fed. Rep. of Germany . |
| 26871 | 1/1964 | German Democratic Rep. . |
| 98298 | 6/1973 | German Democratic Rep. . |

OTHER PUBLICATIONS

*Ullmanns Enzyklopaedie dertechnischen Chemie,* 9, (1932), pp. 640–641.

Ibid, 10 (1958), pp. 518–519.

*Winnacker–Kuechler,* "Chemische Technologie", 5, (1981), p. 457.

Kroenig, "Die Katalytische Druckhydrierung von Kohlen, Teeren und Mineraloelen", (1950), pp. 44, 45, 188 & 189.

Summary or Essential Content of German Patent Nos. 26,871 and 98,298.

*Primary Examiner*—Delbert E. Gantz

*Assistant Examiner*—Chung K. Pak

*Attorney, Agent, or Firm*—Oblon, Fisher, Spivak, McClelland & Maier

[57] ABSTRACT

The residues obtained in the hydrogenation of oil, especially heavy oil, or of coal are subjected to low temperature carbonization in a drum, preferably a rotary drum, at temperatures between approximately 400° C. and approximately 600° C., by means of a carbonization gas after the separation of the condensable portions and heating to temperatures between approximately 600° C. and approximately 950° C. which is introduced into the low temperature carbonization drum. The gas is heated to temperatures between approximately 600° C. and approximately 950° C. indirectly by flue gases arising from the combustion of oil or gas, for example, of excess carbonization gas. The residue to be carbonized at low temperature is introduced into the hot gas in a finely dispersed state and preferably atomized.

10 Claims, 1 Drawing Figure

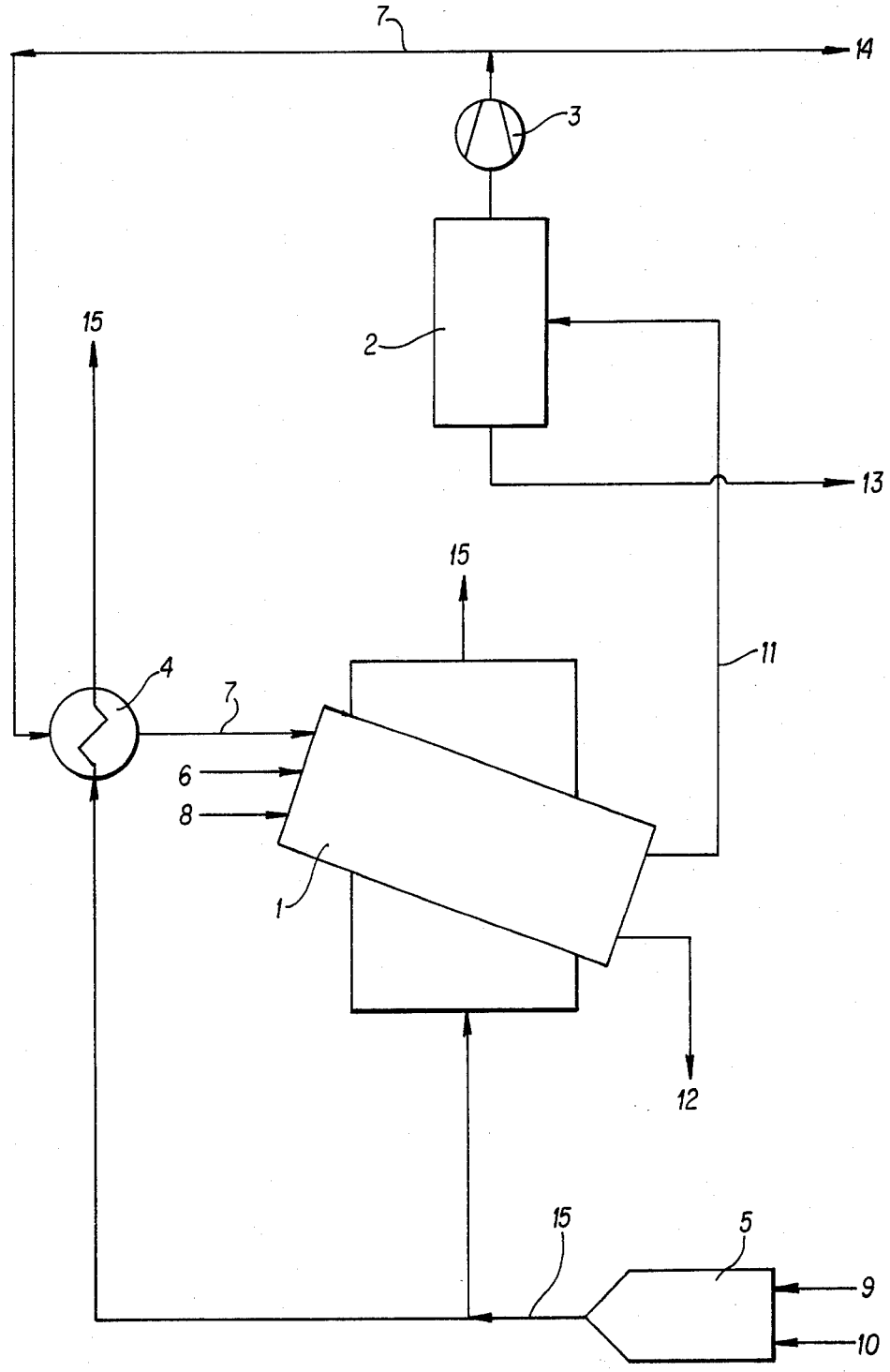
7
14
3
2
15
13
15
11
4
7
6
8
1
12
15
5
9
10

PROCESS FOR LOW TEMPERATURE CARBONIZATION OF HYDROGENATION RESIDUES

BACKGROUND OF THE INVENTION

1. Field of the Invention

This invention relates to an improved process for the low temperature carbonization of residues produced by the hydrogenation of oil, especially heavy oil, or of coal. More specifically, these residues, produced during the hydrogenation process, are subjected to low temperature carbonization in a drum, preferably a rotary drum, at temperatures between 400° C. and 600° C., whereby a carbonization gas is introduced, after the separation of the condensable portions and heating to temperatures between 600° C. and 950° C., into the low temperature carbonization drum and the low temperature carbonization of the residues is thereby effected.

2. Description of the Prior Art

In the hydrogenation of coal and mineral oils, especially of distillation residues of mineral oils as well as of heavy and very heavy oils at temperatures of 400° C.–520° C. and pressures of 100–700 bars in the liquid phase, the hydrogenation product contains, in addition to the desired products that are volatile at the reaction temperature, nonvolatile residues, such as asphaltenes, catalysts and unreacted carbon in coal hydrogenation and/or coal or coke as catalyst supports in oil hydrogenation. The residues are separated from the gaseous product in one or more hot separators and must be reprocessed. In the coal hydrogenation process used in Germany until the end of World War II, residues, optionally after increasing the solids content by centrifuging, were introduced into a low temperature carbonization plant, in which nonvolatile portions were decomposed into gas, oil and coke.

A typical low temperature carbonization plant for the hydrogenation residues consisted of a slightly inclined rotary drum type kiln externally heated by gas burners, into which the pasty residue, preheated to 400° C.–450° C., was introduced and subjected to low temperature carbonization at temperatures of approximately 550° C.–600° C. (cf. W. Kroenig "Die katalytische Druckhydrierung von Kohlen, Teeren und Mineraloelen," Berlin/Goettingen/Heidelberg 1950, especially pages 44–45 and 188–189 as well as M. Hoering and E. E. Donath in "Ullmanns Enzyklopaedie der technischen Chemie," third edition, volume 10, Munich/Berlin 1958, especially pages 518–519.) To avoid coke deposits building up on the inside of the walls of the drum, the latter contained steel balls that removed deposits from the walls as the drum revolved by attrition. About 100 kg of steam per ton of feedstock were introduced into the drum to act as a sweep-through gas.

In this previous and known process, the specific throughput of the low temperature carbonization drum was essentially determined by the heat introduced from the outside per square meter of drum surface. By preheating the residue to be carbonized to a temperature as close as possible to the cracking temperature, the heated drum surface could be correspondingly reduced or the drum throughput increased. However, this method of increasing throughput was limited by the onset of the cracking reaction during the heating period, if the preheating temperature became too high.

Since the contents of the low temperature carbonization drums were heated externally, through the walls of the drums, this process required a great deal of energy and therefore was not very economical. Moreover, the annoyance caused by the noise of the steel balls falling inside the drum was considerable. Furthermore, purification of the foul water resulting from condensation of the sweep-through steam was very expensive. Therefore, it was generally believed that such low temperature carbonization drums or processes would not be used in the future (cf. Winnacker-Kuechler, "Chemische Technologie," Munich/Vienna 1981, Volume 5, page 457).

SUMMARY OF THE INVENTION

In accordance with the present invention, it has surprisingly been discovered that the low temperature carbonization of residues produced during the hydrogenation of coal and mineral oils, especially heavy oils, can be economically and efficiently effected by subjecting these residues to a circulating carbonization gas, heated to temperatures between approximately 600° C. and approximately 950° C. in a drum at temperatures within the range of approximately 400° C. to approximately 600° C.

Futhermore, the process of the present invention has proved to be highly efficient because, among other reasons, the carbonization gas serves not only as a heat transfer medium but also as a sweep-through gas or as a fuel gas after the separation of its condensable portions.

Still further in accordance with the present invention, deposits on the walls of the low temperature carbonization drum may be reduced by injecting the feedstock, i.e., hydrogenation residue, in a finely dispersed form into the carbonization gas stream.

Still further in accordance with the present invention, the efficiency of the process of the present invention is increased by heating the carbonization gas which is introduced into the low temperature carbonization drum by passage through a heat exchanger whereby heat is transferred to the carbonization gas from flue gases produced during the combustion of oil or gas, e.g., carbonization gas that is not needed as recycled gas for recirculation through the carbonization drum.

These and other aspects of the invention will become clear to those skilled in the art upon the reading and understanding of the specification.

BRIEF DESCRIPTION OF THE DRAWINGS

The invention will be further described in connection with the attached drawing FIGURE showing a preferred embodiment of the invention including specific parts and arrangements of parts. It is intended that the drawing included as a part of this specification be illustrative of the preferred embodiment of the invention and should in no way be considered as a limitation on the scope of the invention.

FIG. 1 is a flow diagram illustrating one embodiment of the improved process according to the present invention.

DETAILED DESCRIPTION OF THE PREFERRED EMBODIMENTS

Surprisingly, it has now been found that the disadvantages of drum low temperature carbonization can be avoided if the drum contents, i.e. the low temperature carbonization material, are heated directly by a fuel gas heated to temperatures between approximately 600° C. and approximately 950° C. The gas resulting from the carbonization of the drum contents (i.e. carbonization gas) serves as a fuel gas after the removal of its condensable portions. Furthermore the fuel gas has a higher temperature than the formerly used steam. Thus, it acts not only as a sweep-through gas as did the formerly used steam but also as fuel for the low temperature carbonization of the hydrogenation residue.

The carbonization gas, serving as a heat transfer medium, is circulated between the low temperature carbonization drum, a condenser and a heat exchanger. Condensation occurs in the usual manner, however the process is simpler than the former process due to the absence of steam. This also reduces the environmental problems which were associated with water disposal for the former process. In addition, the condensation stage is smaller and the coolant consumption is reduced. For the reheating of the recycle gas, the heat generated in the burning of the carbonization gas that is not needed as recycle gas can be used. This heat is transferred to the recycle gas by a heat exchanger.

Compared to the former process with preheating of the feedstock to be carbonized, the process of the invention makes possible a specific 50% increase in throughput of the feedstock for the same drum size and has also a lower specific fuel gas requirement. Direct heating by the recycle gas enables the drum size to be reduced for a specific throughput.

Since in the proposed process the low temperature carbonization takes place mainly in the space enclosed within the drum rather than at the drum wall in contrast to the former process, the tendency to form coke deposits on the wall is reduced. The tendency for deposition can be further counteracted by entraining the feedstock in a finely dispersed form, for example by atomisation, into the heating gas stream. Therefore, the use of steel balls in the drum can be abandoned. However, it can be advantageous to entrain additional solid matter together with the feedstock, for example fine coke particles that were produced earlier during the course of the low temperature carbonization, as seed to initiate the formation of coke particles.

As previously described, the heat required for the low temperature carbonization of the hydrogenation residues is introduced into the low temperature carbonization drum for the most part by the circulating carbonization gas. The heating of the drum shell therefore could be dispensed with; however, it has proved to be useful to supply to the drum shell the heat being lost by radiation. This can be accomplished by external heating, for example with excess flue gas.

A non-limiting embodiment according to the process of the invention is explained below in conjunction with the accompanying drawing.

The feedstock, e.g. hydrogenation residue, 6 is atomized into the rotary drum 1, for example, at a temperature of approximately 370° C., where the low temperature carbonization takes place. The drum, which is supported by rollers, is inclined and is driven by a motor. The heat required for low temperature carbonization is supplied directly by recycled carbonization gas 7, for example at a temperature of 600° C.–950° C. In the embodiment of the process illustrated in FIG. 1, the feedstock 6 and fuel gas 7 enter the drum in parallel flow directions. However they can also enter the drum countercurrent to each other. The coke 12 obtained by the low temperature carbonization is discharged from the drum by a suitable device.

The carbonization gases 11 are carried to the condenser 2 in which the low temperature carbonization oil 13 is separated. The uncondensed portions of the carbonization gas are removed by blower 3. Part of the gas stream 14 is transported for further processing and the other part 7 is recycled by way of the heat exchanger 4 to the rotary drum 1. The flue gases 15 produced in the combustion chamber 5 by burning of fuel gas 10, especially excess carbonization gases 14 not needed as recycle gas, with air 9, are cooled in the heat exchanger 4 against the recycled carbonization gas 7, whereby the heat required for direct heating of the drum contents is obtained.

External heating of the drum by flue gases 15 produced by burning of fuel gas 10, especially excess carbonization gas 14, with air 9 in the combustion chamber 5 serves to compensate for heat losses to the surroundings as well as to start up the process.

Solid matter 8 may be added into the rotary drum, especially limestone and/or coke, to bind harmful substances during low temperature carbonization and to promote coke separation.

While the invention has been described and illustrated above with reference to a specific preferred embodiment thereof, those skilled in the art will appreciate that various changes, modifications and substitutions can be made therein without departure from the spirit of the invention. For example, temperature ranges other than the preferred range as set forth hereinabove may be applicable as a consequence of the nature of the various components employed in the process and such other expected variations or differences in results are contemplated in accordance with the practices of the present invention. It is intended, therefore, that the invention be limited only by the scope of the claims which follow.

What is claimed as new and desired to be secured by Letters Patent of the United States is:

1. In a process for the low temperature carbonization of residues obtained from the hydrogenation of oil or of coil in a heated rotary drum at temperatures between approximately 400° C. and 600° C.;

the improvement comprising introducing as the major source of heat a hot gas into said low temperature carbonization drum; wherein carbonization gas is employed as said hot gas after the separation of the condensable portions thereof; and wherein said gas has been heated to temperatures between approximately 600° C. and approximately 950° C.

2. The process according to claim 1, wherein said carbonization gas used as recycle gas is heated to temperatures between approximately 600° C. and approximately 950° C. indirectly by the flue gases arising from the combustion of oil or gas.

3. The process according to claims 1 or 2, wherein said residues are introduced into said hot gas in a finely dispersed state.

4. The process according to claim 3, wherein said residues are atomized for entraining into said hot gas.

5. The process according to claim 1, wherein said drum is an inclined rotary drum.

6. The process according to claim 1, wherein solid matter selected from limestone, coke or mixtures thereof is also added to said drum.

7. The process of claim 2, wherein the flue gases arise from excess carbonization gas.

8. The process of claim 1, wherein the drum is additionally heated in an amount sufficient to compensate for heat lost by radiation by flue gases arising from the combustion of oil or gas.

9. The process of claim 8, wherein the flue gases arise from excess carbonization gas.

10. The process of claim 1 wherein the oil is heavy oil.

* * * * *